US012628916B2

(12) United States Patent
Ben-Arie

(10) Patent No.: US 12,628,916 B2
(45) Date of Patent: May 19, 2026

(54) BUTTON ATTACHMENT CONFIGURATION WITH DETACHABLE PIERCING DEVICE

(71) Applicant: Jezekiel Ben-Arie, Carlsbad, CA (US)

(72) Inventor: Jezekiel Ben-Arie, Carlsbad, CA (US)

( * ) Notice: Subject to any disclaimer, the term of this patent is extended or adjusted under 35 U.S.C. 154(b) by 117 days.

(21) Appl. No.: 18/819,246

(22) Filed: Aug. 29, 2024

(65) Prior Publication Data

US 2026/0060379 A1 Mar. 5, 2026

(51) Int. Cl.
*A44B 1/28* (2006.01)

(52) U.S. Cl.
CPC ..... *A44B 1/28* (2013.01)

(58) Field of Classification Search
CPC ..... A44B 1/28
See application file for complete search history.

(56) References Cited

U.S. PATENT DOCUMENTS 1,981,813 A * 11/1934 Schuster ..... A44B 1/28 24/706.4
2,671,255 A * 3/1954 Kember ..... A44B 1/28 24/114.4
3,389,439 A * 6/1968 Papazian ..... A44B 1/28 411/525
3,623,192 A * 11/1971 Papazian ..... A44B 1/34 411/510
3,691,597 A * 9/1972 Kahn ..... A44B 1/34 24/108
3,725,980 A * 4/1973 Burgio ..... A44B 1/34 24/108
3,982,013 A * 9/1976 Katsuda ..... C07D 307/42 514/464
4,033,012 A * 7/1977 Kramer ..... A44B 1/28 24/95
4,512,063 A * 4/1985 Fukuroi ..... A44B 1/44 24/94
4,662,034 A * 5/1987 Cunningham ..... A44B 1/28 24/94
4,683,621 A * 8/1987 Watanabe ..... A44B 1/44 24/95
4,723,421 A * 2/1988 Nitsche ..... F16B 21/073 63/12
4,751,780 A * 6/1988 Trolltsch ..... B26B 19/044 30/346.51
4,875,257 A * 10/1989 Anderson ..... A44B 1/12 24/114.9

(Continued)

*Primary Examiner* — David M Upchurch

(57) ABSTRACT

A button assembly configured for fast button attachment to a cloth. The assembly includes button attached to a spacer attached to a pole attached to a terminal element and a separate cone. This configuration is retained by a ring with multiplicity of resilient gates. The terminal element has holding cavity at its bottom end. The cone has a pointed end pointing downwards and a wide upper side with an attached holding pole which facilitates temporary attachment to the terminal element. Piercing the cloth downwards, by the cone followed by the terminal element and the pole bends downwards the resilient gates which are situated beneath the cloth. When the terminal element is inserted below the bent ends of the resilient gates, the gates are released, unbend, and trap the terminal element in the ring. This attaches the button on top of the cloth and the cone is detached and discarded.

11 Claims, 13 Drawing Sheets

(56) References Cited

U.S. PATENT DOCUMENTS

| | | | | | |
|---|---|---|---|---|---|
| 4,928,362 | A * | 5/1990 | Collas | A44B 1/08 | 24/94 |
| 5,428,872 | A * | 7/1995 | Papazian | A44B 1/28 | 24/103 |
| 5,575,043 | A * | 11/1996 | Candotti | A44B 1/34 | 24/103 |
| 5,933,929 | A * | 8/1999 | Kawakami | A44B 17/0035 | 24/324 |
| 5,940,940 | A * | 8/1999 | Tanikoshi | A44B 17/0082 | 24/108 |
| 5,975,398 | A * | 11/1999 | Evans | B65C 7/005 | 227/71 |
| 7,137,176 | B2 * | 11/2006 | Flavio | G09F 3/12 | 24/104 |
| 8,522,404 | B2 * | 9/2013 | Matei | A44B 1/28 | 24/104 |
| 8,938,861 | B1 * | 1/2015 | McLendon | A44B 1/185 | 24/103 |
| 9,820,520 | B2 * | 11/2017 | Bolen | A44B 1/08 | |
| 10,004,299 | B2 * | 6/2018 | Maussen | A41F 1/02 | |
| 10,455,901 | B2 * | 10/2019 | Marin | A44B 1/34 | |
| 2001/0005924 | A1 * | 7/2001 | Watanabe | A44B 1/28 | 24/94 |
| 2005/0121479 | A1 * | 6/2005 | de Macedo | G09F 3/0305 | 223/1 |
| 2005/0188510 | A1 * | 9/2005 | Retamal | A44B 1/28 | 24/114.4 |
| 2010/0236029 | A1 * | 9/2010 | Mattei | A44B 1/28 | 24/114.4 |
| 2014/0007382 | A1 * | 1/2014 | Makki | A44B 1/42 | 156/92 |

* cited by examiner

BUTTON ATTACHMENT CONFIGURATION WITH DETACHABLE PIERCING DEVICE

CROSS-REFERENCE TO RELATED APPLICATIONS

Not Applicable.

FEDERALLY SPONSORED RESEARCH

Not Applicable.

SEQUENCE LISTING OR PROGRAM

Not Applicable.

TECHNICAL FIELD

The present invention relates to Buttons Attachment to Garment Cloths.

PRIOR ART

Traditionally buttons are attached to garments by threads. However, sewing buttons is quite slow and laborious. Furthermore, threaded buttons tend to detach after intensive use. Hence, a faster and more robust button attachment method could yield a notable improvement. In our search we have found several inventions of button assemblies that were configured for fast button attachment but all of them are dissimilar to our invention both in their structures and in their principles of operation. Most, if not all of these attachment assemblies rely on some sort of metallic pedestal crimping in order to attach the button to the garment cloth. In U.S. Pat. No. 4,033,012 (Jul. 5, 1977) to Kramer et al. teaches a metallic button held by a metallic pedestal that is stapled to the garment cloth by a four legged metallic staple that is crimped to hold the pedestal. In U.S. Pat. No. 8,522,404 (Sep. 3, 2013) Matei teaches a button which can be tilted because it is attached to an elongated metallic shaft with ball attached at one end. The ball is housed in a ball bearing cavity included in the mounting base attached to the garment. In US 2005/0188510 (Sep. 1, 2005) Retamal teaches a button attached to an elongated serrated metal shaft which fits into a serrated metal nut attached to the garment. In U.S. Pat. No. 4,751,780 (Feb. 25, 1986) Fukuroi teaches a metal button which is attached to a mounting base by a crimped metal nail. In U.S. Pat. No. 4,512,063 (Apr. 23, 1985) Fukuroi teaches a metal button attachment to a base by a metal rivet. In U.S. Pat. No. 5,575,043 (Nov. 19, 1996) Candotti also teaches a metal button attachment to a base by a metal rivet. In U.S. Pat. No. 4,928,362 (May 29, 1990) Collas proposes to mount a metallic button on a metallic shank which is connected to a disk beneath the garment cloth. In U.S. Pat. No. 5,940,940 (Aug. 24, 1999) Tanikoshi teaches a button mounting by crimping a metal tubular rivet. In U.S. Pat. No. 5,975,398 (Nov. 2, 1999) Evans proposed attaching buttons to clothing by H shaped plastic studs which are inserted through the button holes into the clothing. In U.S. Pat. No. 9,820,520 (Nov. 21, 2017) Bolen teaches an attachment system with two parts one part attaches to the clothing side and the other part attaches to the button side and both parts are then coupled by a magnetic twist-lock mechanism. In U.S. Pat. No. 10,004,299 (Jun. 26, 2018) Maussen Teaches a tapered trapezoidal shape buttons which are connected to fabrics using sewing. IN U.S. Pat. No. 3,982,013 (Jul. 1, 1975) Gould teaches a button attachment using a rivet with long serrated shaft that protrudes from the clothing and is attached to a button with fitting aperture. In U.S. Pat. No. 8,938,861 (Jan. 27, 2015) Mclendon teaches a removably attachable button using a pair of U-shaped flexible pins with small hooks at their ends, which are inserted through the clothing and through the button holes.

All the above inventions are entirely dissimilar to our invention.

BRIEF SUMMARY OF THE INVENTION

I have several goals in inventing and developing the Button Assembly (some feasible embodiments are illustrated in FIGS. 1-14) I concentrated on several goals as follows:

1. To develop a Button Assembly which facilitates fast attachment of the buttoning structure to garment's cloths eliminating any need for sewing, tying or metal crimping.
2. To design button assembly structure which facilitates fast manual attachment without needing additional tools or machines.
3. To configure a buttoning structure which can be attached firmly and permanently to garment cloths.
4. To design a retaining structure for the button which can withstand strong pulling forces applied to the button without detachment.
5. To design a button assembly which could be manufactured inexpensively in mass production from common elastic materials such as plastics.
6. To develop a button assembly approach which facilitates creation of a large variety of button's colors and shapes.
7. To configure a retaining structure that employs a trapping mechanism which is constructed from resilient materials such as plastics. Thereby, robustly tying the button to the garment cloth.
8. To configure a button with attachable ornamental caps.
9. To facilitate easy garment's buttoning by integrating into the buttoning structure a spacer that introduces a gap between the button and the clothing.
10. To configure a cone that is temporarily attached to the bottom of the buttoning structure and facilitates easy piercing of the garment cloth during attachment of the buttoning structure to the garment cloth.
11. To configure a temporary attachment structure for the piecing cone, which facilitates easy manual detachment after use.

In order to achieve the objectives listed above, our mechanism for button attachment to the garment cloth uses a trapping mechanism. Wherein trapping is initiated by a forceful downwards intrusion of a terminal element into an upper opening of a ring, The upper opening is attached to set of resilient gates. The downwards intrusion of the terminal element into the ring via the upper opening, bends downwards a multiplicity of resilient flaps (which serve as a multiplicity of resilient gates) that reside at the entrance of the ring which serves as a retaining structure. Next, the bent resilient gates (flaps) are configured to be released when the terminal element is pushed further downwards into the ring (also called retaining structure) below the tips of the bent gates. Next, the released gates unbend due to their elasticity and end up diagonally resting on the pole above the terminal element, thus trapping the terminal element inside the ring in the retaining structure.

The resilient gates are initially bent by a forceful intrusion of the terminal element. The terminal element is a cylindrical object attached to the bottom end of the pole. The top end of the pole is connected to the lower side of the buttoning spacer. The upper side of the spacer is attached to the lower face of the button. Initially, the downwards intrusion of the terminal element into the retaining structure's upper opening pushes and bends downwards the resilient multiplicity of gates (flaps) that are attached at the rim of the upper opening of the retaining structure (the ring). Next, the trapping mechanism is triggered to shut when the terminal element is pushed further downwards into the retaining structure, beyond the tips of the multiplicity of the bent gates (flaps). At that point, the multiplicity of gates (flaps) is released and unbend upwards due to their resiliency and end up resting diagonally on the pole above the terminal element. At this situation, the gates prevent further upwards unbending motion of the released multiplicity of flaps since the flaps' tips are leaning diagonally on the pole. At this point, the multiplicity of gates (flaps) traps the terminal element inside the ring (the retaining structure) because they prevent the terminal element from retracting upwards. The button is also trapped since it is attached to the spacer which is attached to the pole which is attached to the trapped terminal element. While the multiplicity of gates (flaps) is diagonally resting on the pole above the terminal element's upper side, the gates (flaps) are prevented from turning upwards since their tips are diagonally resting on the pole. Hence, the multiplicity of resilient gates (flaps) is configured to prevent the terminal element from moving upwards thereby trapping the terminal element inside the retaining structure.

The manual attachment of the button to the garment cloth is performed as follows:

The button assembly is configured to be used for fast attachment of the button to the garment cloth by placing the retaining structure below the garment cloth such that the retaining structure's upper opening is facing a lower side of the garment cloth while placing the buttoning structure at an upper side of the garment cloth such that the terminal element is opposite the retaining structure's upper opening. Next, pushing downwards the buttoning structure from the upper side of the garment cloth is configured to pierce and penetrate the garment cloth by the terminal element's lower side. Further pushing inserts the terminal element via the ring's upper opening into the retaining structure which is situated at the lower side of the garment cloth. Inserting the terminal element downwards through the retaining structure upper opening is configured to bend the multiplicity of flaps and to trap the terminal element inside the ring when the flaps unbend. At the completion of the terminal element insertion, it is trapped inside the ring (retaining structure) since it is situated beneath the multiplicity of flaps which are diagonally resting on the pole above the terminal element. At that point, the trapped terminal element which is attached to the buttoning structure, is configured to prevent detachment and separation of the buttoning structure from the retaining structure and also from the garment cloth. Thereby, completing the attachment of the button to the garment cloth by permanently attaching the buttoning structure to the garment cloth.

At the end of the button attachment to the cloth, the terminal elements which protrudes under the lower end of the retaining structure has sharp features that can irritate the skin of the user. To avoid irritation, I developed a locking mechanism that has a bowl shaped wall which is attached to the lower opening of the ring. The bowl shaped wall is configured to cover the flange at the protruding lower end of the terminal element.

The buttoning assembly has an ornamental option which enables to easily change the appearance of the button by attaching a cap that covers the upper face of the button. This cap can be endowed with colorful patterns, illustrations or even engravings. The advantage of this feature is that the wearer can frequently change the appearance of their buttons. The caps are made of flexible material which can be easily installed or removed from the button.

In this final step the piercing cone is removed from the terminal element and discarded.

Figure 9:
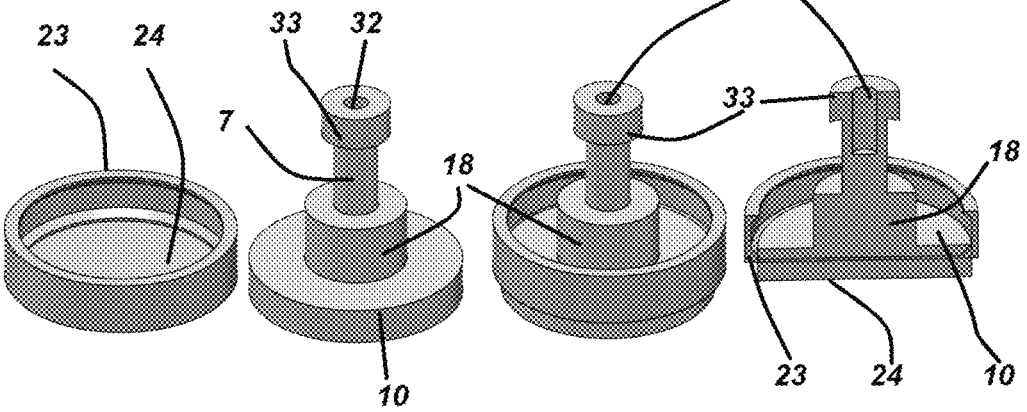

FIG. 9 illustrates in 3D side view isometric drawing the sequencing of cap installment on the button. The left figure shows the cap. The second from the left figure shows the buttoning structure. The third figure from the left illustrates the cap installed on the button. The fourth figure from the left shows a cross section of the installed cap on the button.

Figure 10:
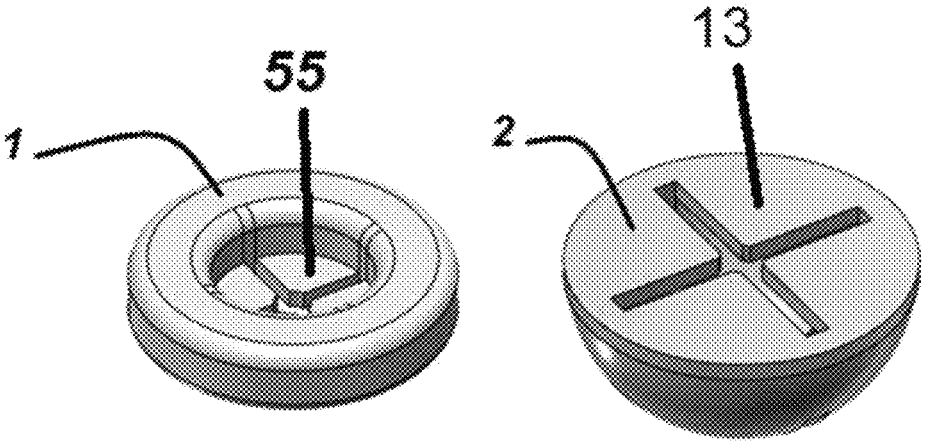

FIG. 10 illustrates in 3D isometric drawing a diagonal side view of the two types of retaining structures. On the left, the ring based retaining structure is depicted. On the right, the retaining structure with the bowl shaped wall is illustrated.

Figure 11:
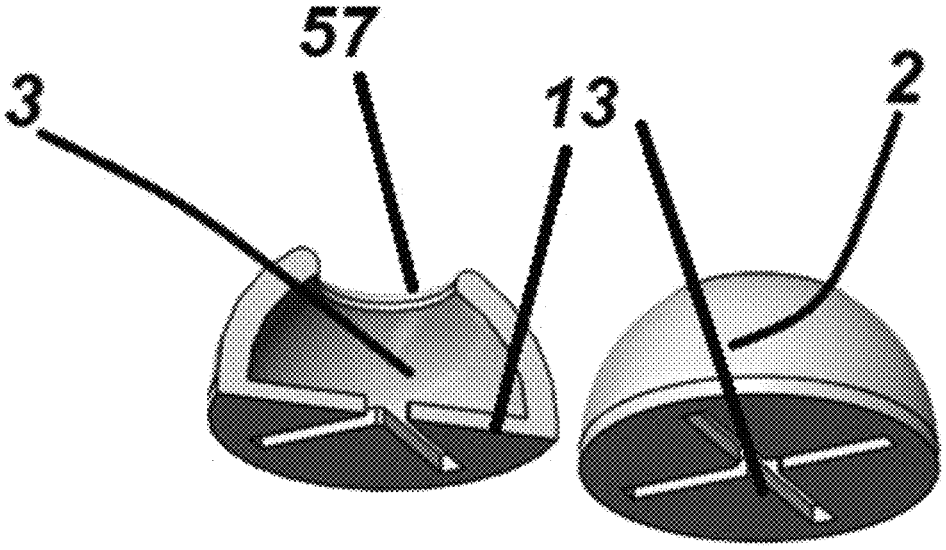

FIG. 11 shows in 3D isometric drawing a side view of the bowl shaped wall retaining structure on the right side. A cross section of the bowl shaped wall retaining structure is depicted on the left side. In FIG. 11, the ball shaped walls are shown inverted.

Figure 12:
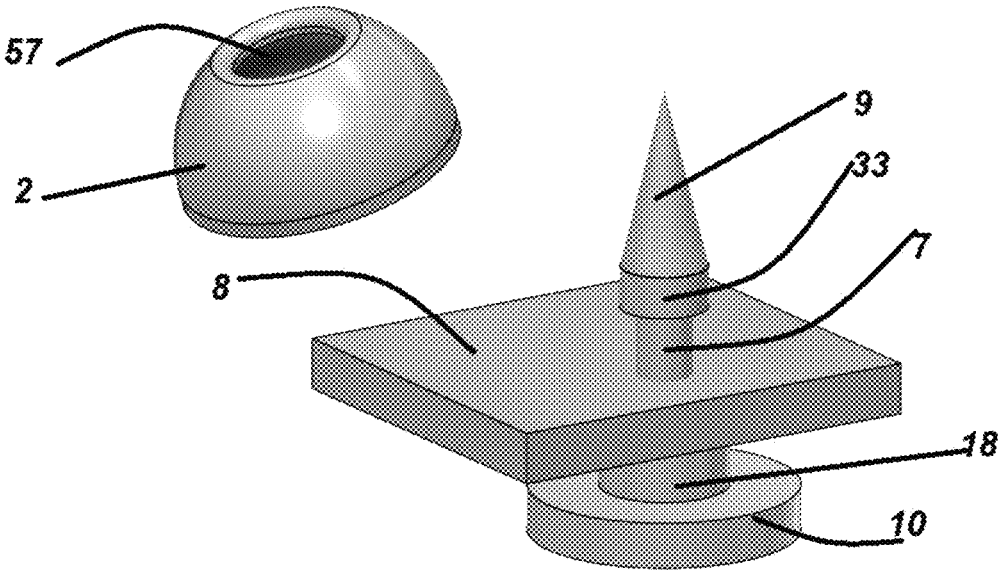

FIG. 12 illustrates in 3D isometric drawing a diagonal side view of the garment cloth pierced by the buttoning structure with the bowl shaped wall retaining structure on the left side. The bowl shaped wall in FIG. 12 is shown inverted.

Figure 13:
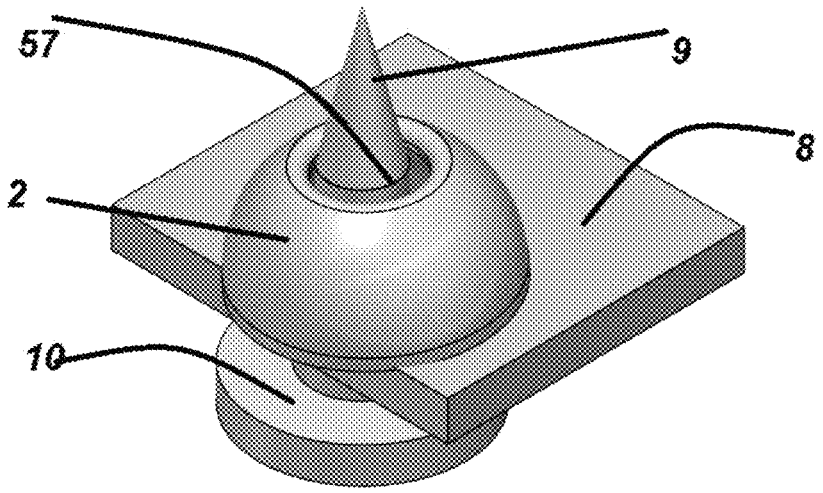

FIG. 13 illustrates in 3D isometric drawing a diagonal side view of the garment cloth pierced by the buttoning structure with the installed bowl shaped wall retaining structure. The bowl shaped wall is depicted inverted in FIG. 13.

Figure 14:
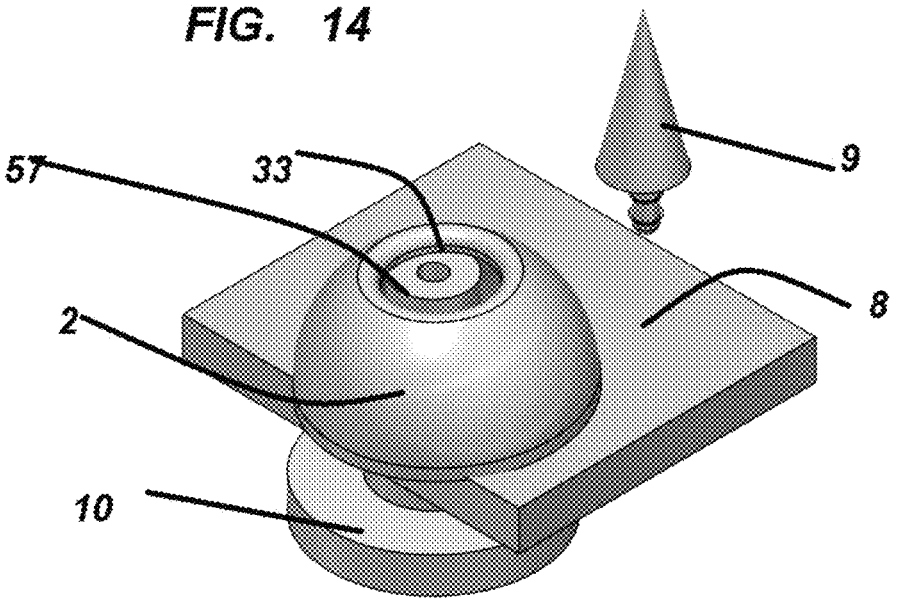

FIG. 14 illustrates in 3D isometric drawing a diagonal side view of the garment cloth pierced by the buttoning structure with the installed bowl shaped wall retaining structure after the removal of the piercing cone. The bowl shaped wall is shown inverted in FIG. 14. The removed cone is depicted on the right.

DETAILED DESCRIPTION OF THE DRAWINGS

Figure 1:
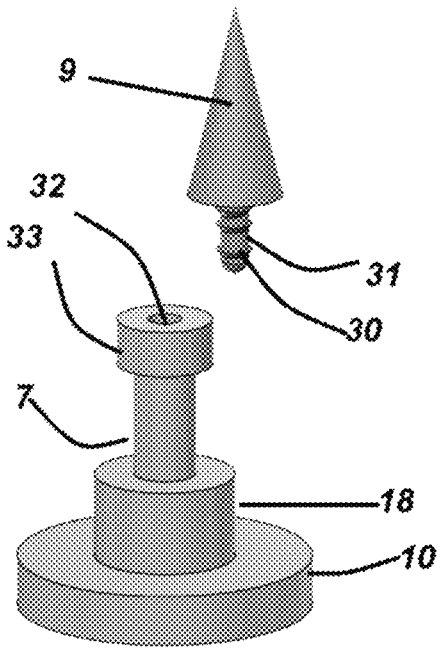
FIG. 1 displays a side view embodiment of the buttoning structure with separated piercing cone in 3D isometric drawing.

FIG. 1 displays a side view embodiment of the buttoning structure with separated piercing cone in 3D isometric drawing. The bottom of the buttoning structure 18 supports the spacer 10 which supports the pole 7. The terminal element 33 is attached on top of the pole. The holding cavity 32 is drilled on the center's top of the terminal element 33. The cone 9 is illustrated above the terminal element. A holding pole is attached at the center of the cone's wide basis. The holding pole 30 is encircled by 3 conic flap rings 31 which are attached to the holding pole to strengthen its holding friction when inserted into the holding cavity 32.

Figure 2:
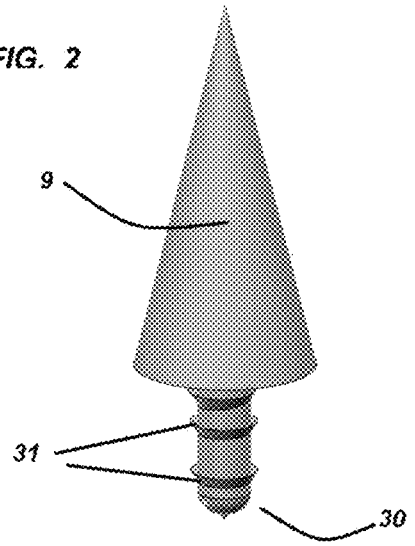
FIG. 2 Depicts in 3D isometric drawing an enlarged side view of the piercing cone.

FIG. 2 Depicts in 3D isometric drawing an enlarged side view of the piercing cone 9. A holding pole 30 is attached at the center's bottom of the con's wide basis. The holding pole 30 is encircled by 3 conic flap rings 31 which are introduced to enhance the holding friction of the pole 30 when inserted into the holding cavity (32 in FIG. 1).

Figure 3:
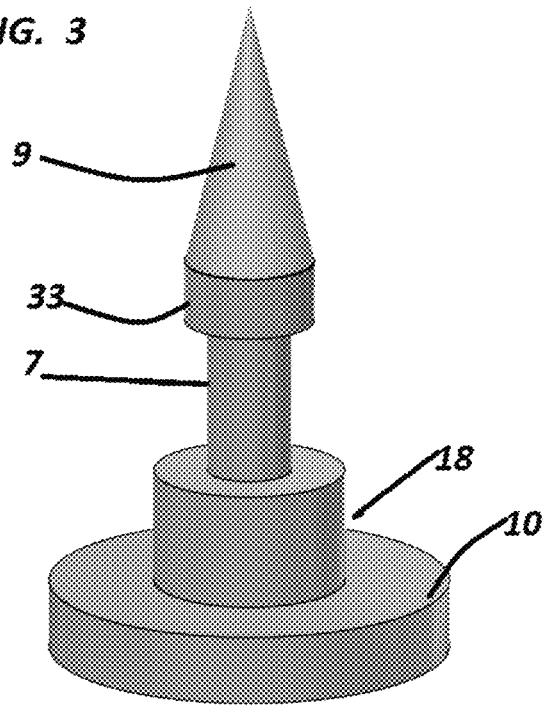
FIG. 3 Illustrates in 3D isometric drawing a side view embodiment of the buttoning structure.

FIG. 3 Illustrates in 3D isometric drawing a side view embodiment of the entire buttoning structure. The bottom of the buttoning structure 18 supports the spacer 10 which supports the pole 7. The terminal element 33 is attached on top of the pole. The cone 9 is temporarily installed on the top of the terminal element 33. In this configuration the buttoning structure is configured to pierce and penetrate the garment cloth.

Figure 4:
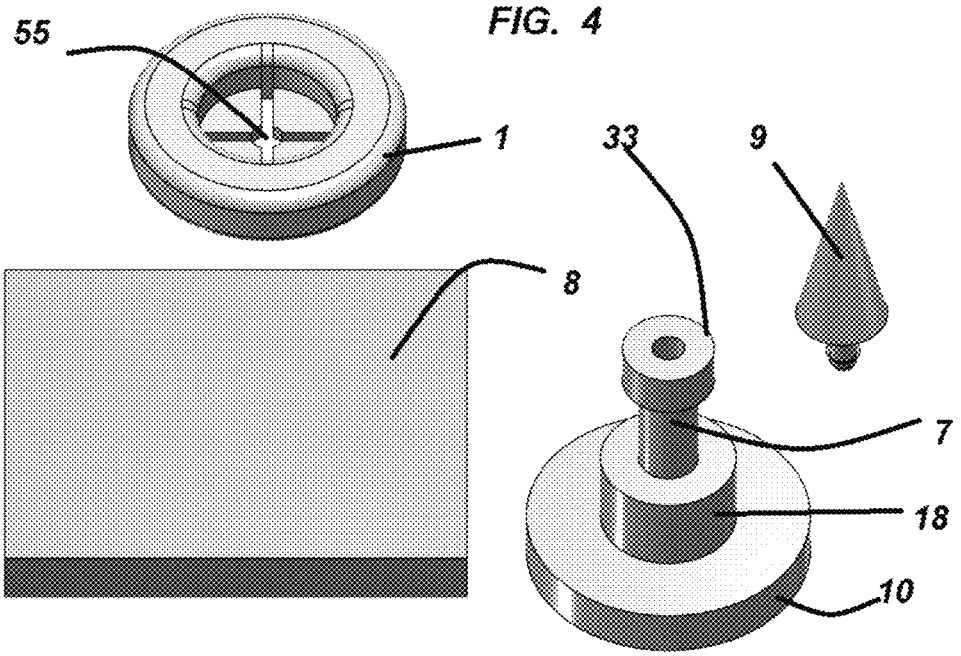
FIG. 4 illustrates in 3D isometric drawing a side view of a collection of components required for a buttoning demonstration. The collection includes the buttoning structure, the retaining structure and the garment cloth.

FIG. 4 illustrates in 3D isometric drawing a side view of a collection of components required for a buttoning demonstration. The collection includes the buttoning structure (10, 18, 7, 33, 9) and the retaining structure 1 (which is drawn on the left-hand side). The retaining structure includes the ring 1 and the resilient gates 55. The garment cloth 8 is illustrated on the right-hand side.

Figure 5:
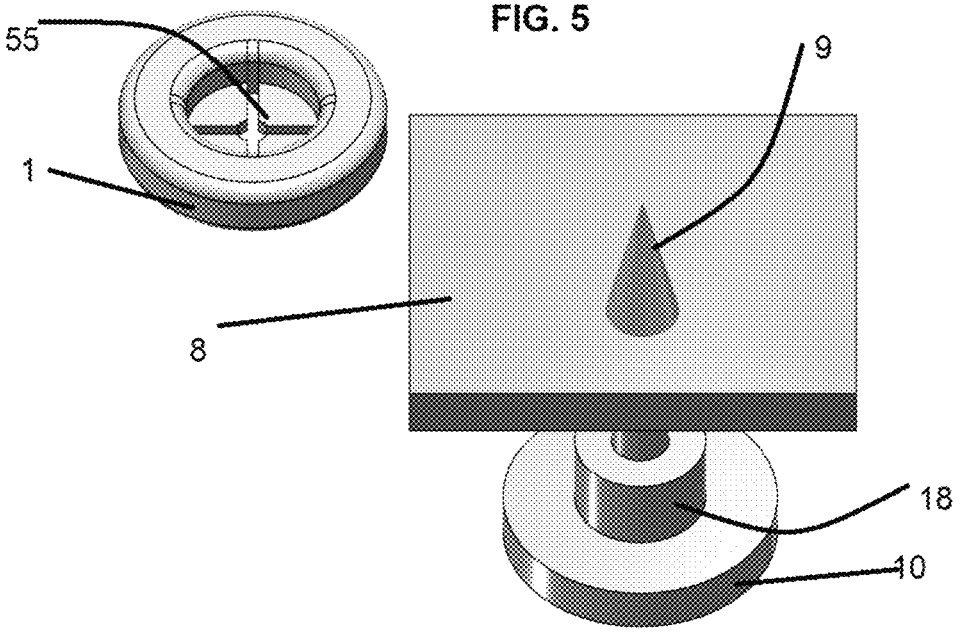
FIG. 5 illustrates in 3D isometric drawing a side view of the first step in buttoning structure instalment on a garment cloth. In this step the garment cloth is initially pierced by the piercing cone.

FIG. 5 illustrates in 3D isometric drawing a side view of the first step in buttoning structure instalment on a garment cloth 8. In this step, the garment cloth 8 is initially pierced by the piercing cone 9. The ring and the resilient gates 1 are separately illustrated on the left-hand side.

Figure 6:
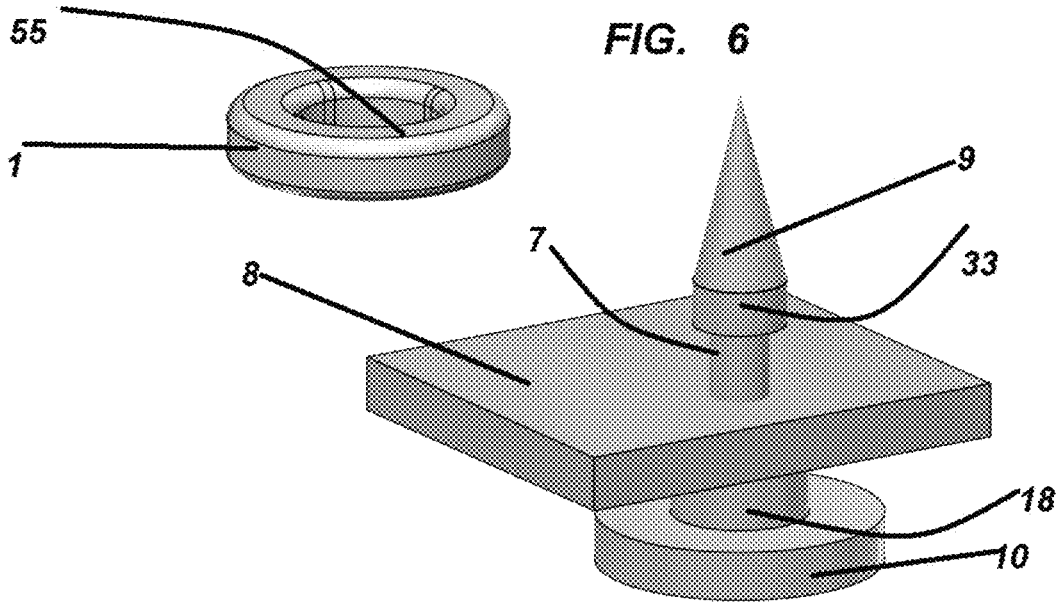
FIG. 6 illustrates in 3D isometric drawing a side view of the second step in buttoning structure instalment on a garment cloth. In this step the garment cloth has been fully penetrated by the piercing cone which was followed by the terminal element.

FIG. 6 shows in 3D isometric drawing a side view of the second step in buttoning structure instalment on a garment cloth 8. In this step the garment cloth 8 has been fully penetrated by the piercing cone 9 which was followed by the terminal element 33. The retaining structure 1 is separately depicted on the left-hand side.

Figure 7:
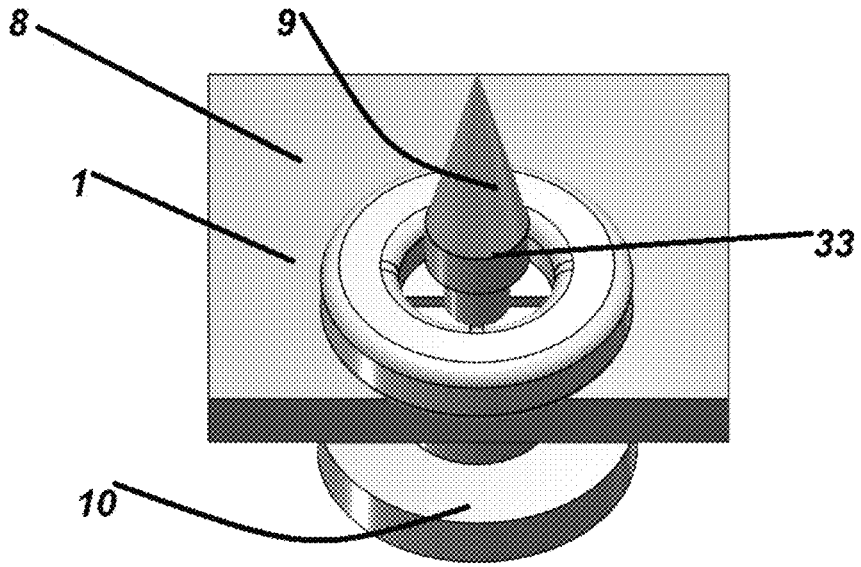
FIG. 7 illustrates in 3D isometric drawing a side view of the third step in buttoning structure instalment on a garment cloth. Previously, the garment cloth had been fully penetrated by the piercing cone which was followed by the terminal element. In this step, the retaining structure which includes the ring, and the multiplicity of the resilient gates is installed below the terminal element.

FIG. 7 illustrates in 3D isometric drawing a side view of the third step in buttoning structure instalment on a garment cloth 8. Previously, the garment cloth 8 has been fully penetrated by the piercing cone 9 which was followed by the terminal element (33 in FIG. 6). In this step, the retaining structure 1, which includes the ring 1 and the multiplicity of the resilient gates (3 in FIG. 4) is installed below the terminal element 33. At this stage, the terminal element 33 has been trapped by the resilient gates 3 of the retaining structure 1.

Figure 8:
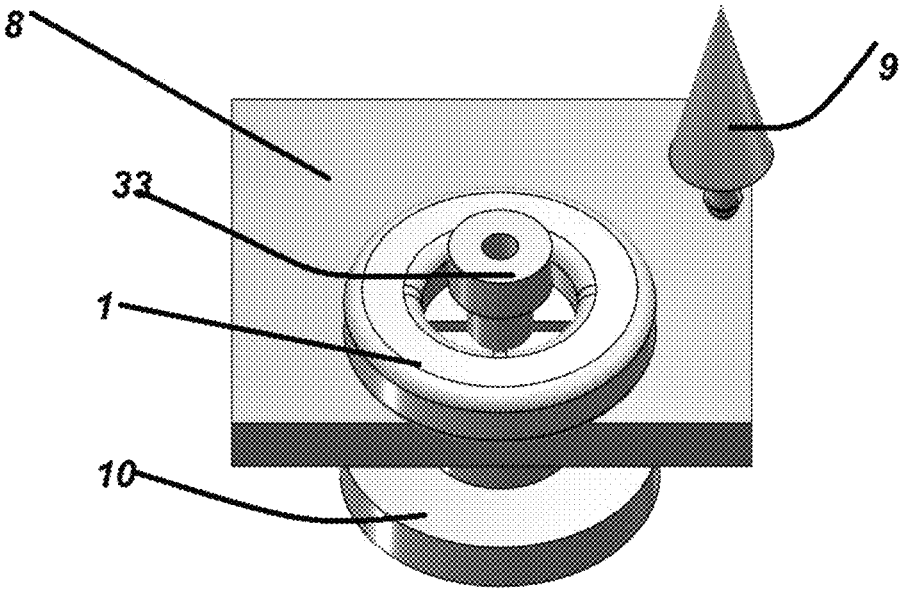
FIG. 8 illustrates in 3D isometric drawing a side view of the fourth step in buttoning structure instalment on a garment cloth. In previous steps the garment cloth has been fully penetrated by the piercing cone which was followed by the terminal element and the retaining structure was installed.

FIG. 8 depicts in 3D isometric drawing a side view of the fourth step in buttoning structure instalment on a garment cloth 8. In previous steps, the garment cloth 8 has been fully penetrated by the piercing cone 9 which was followed by the terminal element 33 and the retaining structure 1 was installed below the terminal element 33. In this final step the piercing cone 9 is removed from the terminal element 33 and discarded.

FIG. 9 illustrates in 3D side view isometric drawing the sequencing of cap installment on the button. The left figure shows the cap 23. The cap's top 24 is Shawn as well. The second from the left figure shows the buttoning structure 10-18-7-33. The third figure from the left illustrates the cap 23-24 installed on the button 10. The fourth figure from the left shows a cross section of the installed cap 23-24 on the button 10.

FIG. 10 illustrates in 3D isometric drawing a diagonal side view of the two types of retaining structures. On the left, the ring based retaining structure 1 is depicted with the resilient gates 55. On the right, the retaining structure with a bowl-shaped wall 2 is illustrated with the resilient gates 13. Notice that the bowl-shaped wall is inverted in FIG. 10. The bowl-shaped wall has an opening on bottom of the bowl 57 which is configured to facilitate the extraction of the piercing cone (9 in FIG. 1) after completion of installation.

FIG. 11 shows in 3D isometric drawing a side view of the bowl-shaped wall retaining structure 2 on the right side. A cross section of the bowl-shaped wall structure is depicted with the resilient gates 13 on the left side. The bowl-shaped wall in FIG. 11 is shown inverted. The inner volume 3 is also shown with the extraction opening 57.

FIG. 12 illustrates in 3D isometric drawing a diagonal side view of the garment cloth 8 pierced by the buttoning structure's cone 9. The bowl-shaped wall retaining structure 2 is depicted inverted on the left side with the extraction opening 57.

FIG. 13 depicts in 3D isometric drawing a diagonal side view of the garment cloth 8 pierced by the buttoning structure 10 with the installed bowl-shaped wall retaining structure 2. Note that the bowl-shaped wall is depicted inverted in FIG. 13 and has an extraction opening 57 on top. This is the third step of retaining structure installation.

FIG. 14 depicts in 3D isometric drawing a diagonal side view of the garment cloth 8 pierced by the buttoning structure 10 with the installed bowl-shaped wall retaining structure 2 after the removal of the piercing cone 9. The bowl-shaped wall has an extraction opening 57 on top. Note that the bowl-shaped wall is shown inverted in FIG. 14. The removed cone is depicted on the right-hand side.

What is claimed is:

1. A button assembly configured for a button attachment on a cloth;

wherein the button assembly comprises a buttoning structure and a retaining structure;

wherein the buttoning structure comprises: the button, a spacer, a pole, a terminal element and a cone;

wherein the button includes a button's lower face and a button's upper face;

wherein the spacer includes a spacer's upper side and a spacer's lower side;

wherein the pole includes a pole's top end and a pole's bottom end;

wherein the terminal element includes a terminal element's upper side and a terminal element's lower side;

wherein the terminal element's lower side includes a holding cavity which is drilled into the terminal element's lower side;

wherein the cone has a pointed end pointing downward and an upper wide basis;

wherein the upper wide basis has an attached holding pole;

wherein the holding pole is configured to fit snugly into the holding cavity;

wherein the button's lower face is attached to the spacer's upper side;

wherein the spacer's lower side is attached to the pole's top end;

wherein the pole's bottom end is attached to the terminal element's upper side;

wherein the holding pole is fitted into the holding cavity; whereby, the cone's upper wide basis is temporarily engaged with the terminal element's lower side;

wherein a piercing structure is defined as a segment of the buttoning structure which includes: the pole, the terminal element and the cone;

wherein the piercing structure is configured to pierce and penetrate the cloth when pushed onto the cloth;

wherein the retaining structure comprises a ring that houses a trapping mechanism;

wherein the ring also includes an upper opening and a lower opening;

wherein the trapping mechanism includes a multiplicity of resilient gates which is attached to the ring;

wherein the multiplicity of resilient gates is configured to facilitate an unidirectional downwards translation of the piercing structure via the upper opening into the ring;

wherein the piercing structure is configured to move downwards when pushed downwards;

wherein when pushed downwards by the piercing structure, the multiplicity of resilient gates is configured to bend downwards and to open the upper opening and to facilitate the unidirectional downwards translation of the piercing structure via the upper opening into the ring;

wherein the unidirectional downwards translation of the piercing structure via the upper opening into the ring is considered as completed when the terminal element's upper side translates below the bent multiplicity of resilient gates;

when translation of the piercing structure is completed, the multiplicity of resilient gates is configured to partially unbend and to diagonally rest on the pole above the terminal element while trapping the piercing structure within the ring by preventing any translation upwards of the terminal element;

the button assembly is configured to facilitate the button attachment to the cloth by placing the retaining structure with the upper opening below the cloth such that the upper opening is facing a lower side of the cloth while placing the buttoning structure above the cloth facing an upper side of the cloth such that the piercing structure is opposite the upper opening;

next, pushing downwards the buttoning structure along with the piercing structure from the upper side of the cloth is configured to pierce the cloth by the cone's pointed end and also is configured to insert the piercing structure via the upper opening downwards into the ring;

wherein inserting downwards, the piercing structure into the upper opening is configured to bend downwards the multiplicity of resilient gates while facilitating the unidirectional downwards translation of the piercing structure via the upper opening into the ring;

next, following the completion of downwards insertion of the piercing structure into the ring, the multiplicity of resilient gates is configured to partially unbend until resting diagonally on the pole while trapping the terminal element in the ring by preventing any translation upwards of the terminal element from the ring;

following the completed translation of the piercing structure via the trapping mechanism the temporarily coupled cone can be separated from the terminal element and discarded;

the multiplicity of resilient gates also is configured to prevent any translation upwards of the buttoning structure including the button, which is connected to the currently trapped terminal element;

wherein, trapping the terminal element which is attached to the buttoning structure, is configured to prevent the buttoning structure from moving upwards, away from the retaining structure and away from the cloth;

wherein, trapping the terminal element is configured to attach the button to the retaining structure and to the cloth.

2. The button assembly of claim 1, wherein the retaining structure includes a planar plate made of a resilient material;

wherein the upper opening has an upper rim;

wherein the upper rim is attached to the planar plate which is configured to be large enough to cover entirely the upper opening;

wherein the trapping mechanism includes the multiplicity of resilient gates which is manufactured from the planar plate which is divided into a multiplicity of resilient flaps by a multiplicity of radial slits which emanate from a radial center located at an upper opening's center;

the multiplicity of resilient flaps which serve as the multiplicity of resilient gates, is configured to facilitate the unidirectional downwards translation of the piercing structure via the upper opening into the ring by bending and turning downwards when the piercing structure is pushed downwards via the upper opening;

when the terminal element is pushed further downwards into a position below the maximally bent multiplicity of resilient gates, the multiplicity of resilient gates is configured to be released and is configured to unbend while turning upwards due to their resiliency; the multiplicity of resilient gates is configured to end its unbending motion by turning upwards until it is stopped by diagonally resting on the pole above the terminal element's upper side;

while the multiplicity of resilient gates is diagonally resting on the pole above the terminal element's upper side, they are configured to prevent the terminal element from moving upwards, thereby trapping the terminal element inside the ring and preventing any upwards translation of the terminal element from the ring;

the button assembly is configured to facilitate the button attachment to the cloth by placing the retaining structure below the cloth such that the upper opening is facing a lower side of the cloth while placing the buttoning structure above the cloth facing an upper side of the cloth such that the piercing structure is opposite the upper opening;

next, pushing downwards the piercing structure from the upper side of the cloth is configured to pierce the cloth by the piercing structure; wherein pushing further downwards the piercing structure, the piercing structure is configured to insert the cone followed by the terminal element via the upper opening downwards into the ring;

next, following the downwards insertion of the terminal element into the ring, the multiplicity of resilient flaps is configured to trap the terminal element within the ring by preventing any translation upwards of the terminal element;

the multiplicity of resilient flaps also is configured to prevent any translation upwards of the buttoning structure, which is connected to the terminal element;

wherein, trapping the terminal element which is attached to the buttoning structure, is configured to prevent the buttoning structure from moving upwards, away from the retaining structure and the cloth;

wherein, trapping the terminal element is configured to attach the button to the retaining structure and to the cloth.

3. The button assembly of claim 2, wherein a bowl-shaped wall attached to the lower opening of the ring which is configured to be large enough to house the terminal element;

wherein attaching the ring by the bowl-shaped wall is configured to protect a user from a sharp ended protrusion of the terminal element;

the bowl-shaped wall also includes a bottom opening which facilitates removal of the cone after piercing.

4. The button assembly of claim 1, wherein the button's upper face is configured to be ornamentally engraved or sculpted.

5. The button assembly of claim 1, wherein the button is configured to fit snugly into a cap;

wherein the cap is configured to be made of an elastic material which facilitates installment on the button and also facilitates removal of the cap from the button;

wherein the cap is configured to have a cap's upper face;

wherein the cap's upper face is ornamentally engraved or painted.

6. The button assembly of claim 2, wherein a multiplicity of diagonal flaps is attached to a surface of the holding pole;

wherein, the multiplicity of diagonal flaps is configured to increase a holding friction between the holding pole and the holding cavity.

7. A button assembly configured for a button attachment on a cloth;

wherein the button assembly comprises a buttoning structure and a retaining structure;

wherein the buttoning structure comprises: the button, a spacer, a pole, a terminal element and a cone;

wherein the button includes a button's lower face and a button's upper face;

wherein the spacer includes a spacer's upper side and a spacer's lower side;

wherein the pole includes a pole's top end and a pole's bottom end;

wherein the terminal element includes a terminal element's upper side and a terminal element's lower side;

wherein the terminal element's lower side includes a holding cavity which is drilled into the terminal element's lower side;

wherein the cone has a pointed end pointing downward and an upper wide basis;

wherein the upper wide basis includes an attached holding pole which is configured to fit snugly into the holding cavity;

wherein the button's lower face is attached to the spacer's upper side;

wherein the spacer's lower side is attached to the pole's top end;

wherein the pole's bottom end is attached to the terminal element's upper side;

wherein the holding pole is fitted into terminal element's holding cavity; whereby, the cone's upper wide basis is temporarily engaged with the terminal element's lower side;

wherein a piercing structure is defined as a segment of the buttoning structure which includes: the pole, the terminal element and the cone;

wherein the piercing structure is configured to pierce and penetrate the cloth when pushed onto the cloth;

wherein the retaining structure comprises a ring that houses a trapping mechanism;

wherein the ring also includes an upper opening;

wherein the trapping mechanism includes a resilient gate which is made of a resilient bar which has a first bar's end which is attached to the upper opening while a second bar's end is unattached and free to bend;

wherein the resilient gate is configured to facilitate an unidirectional downwards translation of the piercing structure via the upper opening into the ring;

wherein the piercing structure is configured when pushed downwards, to move downwards while bending downwards the resilient gate;

wherein when pushed downwards by the piercing structure, the resilient gate is configured to bend downwards while opening the upper opening and to facilitate the unidirectional downwards translation of the piercing structure via the upper opening into the ring;

after the unidirectional downwards translation of the piercing structure moves the terminal element's upper side below the bent second bar's end, the resilient gate bending is released and the resilient gate is configured to unbend upwards until resting diagonally on the pole above the terminal element;

while resting on the pole, the resilient gate is configured to trap the piercing structure within the ring while preventing any translation upwards of the piercing structure from the ring;

the button assembly is configured to facilitate the button attachment to the cloth by placing the retaining structure with the upper opening below the cloth such that the upper opening is facing a lower side of the cloth while placing the buttoning structure above the cloth facing an upper side of the cloth such that the piercing structure is opposite the upper opening;

next, pushing downwards the buttoning structure along with the piercing structure from the upper side of the cloth is configured to pierce the cloth by the cone's pointed end and also is configured to insert the piercing structure via the upper opening downwards into the ring;

wherein inserting downwards, the piercing structure into the upper opening is configured to bend downwards the resilient gate while facilitating the unidirectional downwards translation of the piercing structure via the upper opening into the ring;

next, following the completion of downwards insertion of the piercing structure into the ring, the resilient gate is configured to partially unbend until stopping by resting diagonally on the pole above the terminal element while trapping the terminal element in the ring by preventing any translation upwards of the terminal element from the ring;

following the completed translation of the piercing structure via the trapping mechanism the temporarily coupled cone can be separated from the terminal element and discarded;

the resilient gate also is configured to prevent any translation upwards of the buttoning structure including the button, which is connected to the currently trapped terminal element;

wherein, trapping the terminal element which is attached to the buttoning structure, is configured to prevent the buttoning structure from moving upwards, away from the retaining structure and from the cloth.

8. The button assembly of claim 7, wherein the ring is attached to a bowl-shaped wall which is configured to be large enough to house the terminal element; wherein attaching the ring to the bowl-shaped wall is configured to protect a user from a sharp ended protrusion of the terminal element; the bowl-shaped wall also includes a bottom opening which facilitates removal of the cone after piercing.

9. The button assembly of claim 7, wherein the button's upper face is configured to be ornamentally engraved or sculpted.

10. The button assembly of claim 7, wherein the button is configured to fit snugly into a cap;

wherein the cap is configured to be made of an elastic material which facilitates installment on the button and also facilitates removal of the cap from the button;

wherein the cap is configured to have a cap's upper face;

wherein the cap's upper face is ornamentally engraved or painted.

11. The button assembly of claim 7, wherein a multiplicity of diagonal flaps is attached to a surface of the holding pole;

wherein, the multiplicity of diagonal flaps is configured to increase a holding friction between the holding pole and the holding cavity.

* * * * *